US005839888A

United States Patent [19]

Harrison

[11] Patent Number: 5,839,888

[45] Date of Patent: Nov. 24, 1998

[54] WELL SERVICE PUMP SYSTEMS HAVING OFFSET WRIST PINS

[75] Inventor: Curtis Harrison, Benbrook, Tex.

[73] Assignee: Geological Equipment Corp., Fort Worth, Tex.

[21] Appl. No.: 819,918

[22] Filed: Mar. 18, 1997

[51] Int. Cl.[6] ..... F04B 23/04

[52] U.S. Cl. ..... 417/521; 417/338; 417/568; 92/147; 92/165 R

[58] Field of Search ..... 417/521, 338, 417/568

[56] References Cited

U.S. PATENT DOCUMENTS

| | | | |
|---|---|---|---|
| 4,381,179 | 4/1983 | Pareja | 417/539 |
| 5,246,355 | 9/1993 | Matzner et al. | 417/521 |

FOREIGN PATENT DOCUMENTS

| | | | |
|---|---|---|---|
| 2634379 A | 2/1978 | Germany | 417/521 |

*Primary Examiner*—Charles G. Freay
*Assistant Examiner*—Cheryl J. Tyler
*Attorney, Agent, or Firm*—Geoffrey A. Mantooth

[57] ABSTRACT

A pump system has first and second pumps. Each pump has a housing, which housing has an inboard end and an outboard end. The pumps are arranged so that the inboard ends are adjacent to each other. The inboard ends each have a crankshaft, while the outboard ends each have an output manifold. Each crankshaft is connected to a plunger by way of a connecting rod and a crosshead. The crosshead reciprocates inside of a cylinder. The crosshead has an axis that is coplanar with a rotational axis of the crankshaft. The connecting rod is connected to the crosshead by way of a wrist pin. The wrist pin is offset from the cylinder axis in order to allow the respective pump to be compact in length. The first and second pumps are on a trailer. In the first pump, the wrist pin is offset on one side of the respective cylinder axis, while in the second pump, the wrist pin is offset on the opposite side of the respective cylinder axis. The respective crankshafts are rotated so that during the exhaust stroke of the respective plungers, the wrist pin and the crankshaft end of the connecting rod are located on the same side of the cylinder axis.

3 Claims, 2 Drawing Sheets

WELL SERVICE PUMP SYSTEMS HAVING OFFSET WRIST PINS

FIELD OF THE INVENTION

The present invention relates to pumps that are used in well service applications.

BACKGROUND OF THE INVENTION

Well service pumps are used in the oil and gas industry to pump fluids down a well. The pumps can be used in fracturing, acidizing, cementing, sand control, well control and circulation operations.

A common type of pump used by the oil and gas industry is exemplified by Giraudeau, U.S. Pat. No. 2,766,701, which describes a plunger type pump. The pump has a crankshaft rotated by a prime mover, such as a diesel engine. The crankshaft is connected to one or more plungers by way of a respective connecting rod and crosshead. The connecting rod reciprocates the crosshead inside of a cylinder. The crosshead in turn reciprocates a plunger. The free end of the plunger is located in an output manifold, wherein fluid is pressurized and forced out of the pump on the exhaust stroke of the plunger.

Oil and gas wells are frequently located in areas far from transportation hubs. A common way of delivering pumps to the well site for pumping operations is by truck or trailer. It is desirable to make the well service pumps as small as possible in order to conserve space on the truck or trailer for other equipment. Frequently, it is desirable to locate two well service pumps across the width of the truck, with the input drives (for the crankshafts) located near the center line of the truck and the output manifolds located along the outer sides of the truck. Positioning the output manifolds in this manner allows an operator to easily access the output manifold while standing on the ground near the truck.

SUMMARY OF THE INVENTION

It is an object of the present invention to provide a well service pump system that is compact in size so that two pumps can be loaded on to a truck or trailer across the width of the truck or trailer.

The system of pumps of the present invention is for use in servicing wells. The system includes a first pump and second pump. Each of the first and second pumps have a housing, a plunger, a manifold, a crankshaft, and a connecting rod. Each housing has a cylinder which has a cylinder axis. The housing has first and second ends. The plunger has a crosshead that is reciprocally carried in the cylinder for movement between a suction stroke and an exhaust stroke. The manifold is mounted to the second end of the housing and is adjacent to the cylinder for supplying and delivering liquid that is acted on by the plunger. The crankshaft is mounted rotatably in the housing and has a crankshaft axis that is perpendicular to the cylinder axis. The connecting rod has a crankshaft end that is connected to the crankshaft and the crosshead end that is connected to the crosshead of the plunger by way of a wrist pin. The plunger reciprocates in response to the rotation of the crankshaft. The crankshaft end has a center line. The crankshaft axis is coplanar with cylinder axis while the wrist pin of the connecting rod is offset from the cylinder axis. The first and second pumps are arranged together so that the first end of the first pump housing is adjacent to the first end of the second pump housing. The first pump has the first pump wrist pin located in a first direction from the first pump cylinder axis such that as the first pump plunger moves through its exhaust stroke, the crankshaft end of the first pump connecting rod is located on the same side of the first pump cylinder axis as the first pump wrist pin. The second pump has the second pump wrist pin located in a second direction from the second pump cylinder axis such that as the second pump plunger moves through its exhaust stroke, the crankshaft end of the second pump connecting rod is located on the same side as the second pump cylinder axis.

In one aspect of the present invention, the first and second pumps are mounted on a vehicle. The vehicle has a width that extends between two sides. The second end of the first pump housing is located adjacent to one of the vehicle sides and the second end of the second pump housing is located adjacent to the other of the vehicle sides.

There is also presented a method of pumping fluid. First and second pumps are provided, each of which has a housing. Each housing has a inboard end and an outboard end, with each outboard end having an output manifold. The first and second pumps are mounted so that the inboard ends are adjacent to each other. Each of the first and second pumps have a cylinder and a crankshaft. The cylinder has a cylinder axis and the crankshaft has a crankshaft axis that is coplanar with the cylinder axis. Each of the first and second pumps has a connecting rod that connects to a crosshead in the cylinder by way of wrist pin. The wrist pin is offset from the respective cylinder axis.

The step of mounting the first and second pumps also comprises orienting the first pump with the respect to the second pump such that the wrist pin in the first pump is offset in a first direction from the first pump cylinder axis and the wrist pin in the second pump is offset in a second direction from the second pump cylinder axis. The crankshaft to the first pump is rotated in third direction so that both the wrist pin of the first pump and a crankshaft end of the connecting rod of the first pump are located on the same side of the first pump cylinder axis during an exhaust stroke of the first pump. The crankshaft of the second pump is rotated in a fourth direction so that both the wrist pin of the second pump and a crankshaft end of the connecting rod of the second pump are located on the same side of the second pump cylinder axis during an exhaust stroke of the second pump.

DESCRIPTION OF THE PREFERRED EMBODIMENT

Figure 1:
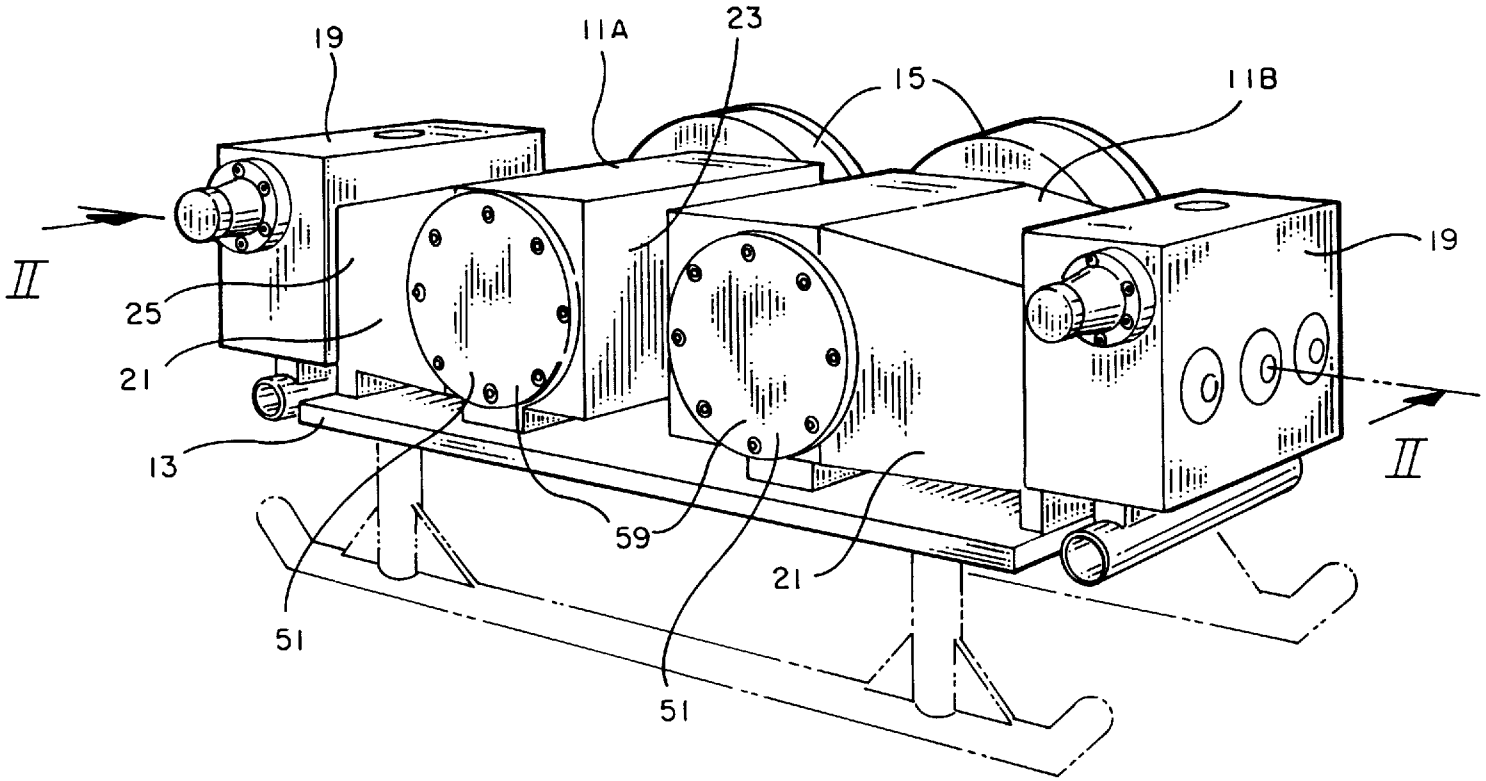
FIG. 1 is a perspective view of two pumps of the present invention, in accordance with a preferred embodiment, positioned in and end-to-end arrangement with respect to each other.

Referring to FIG. 1, there is shown a perspective view of the two pumps 11A, 11B of the present invention, in accordance with a preferred embodiment. Each pump 11A, 11B is used to pump fluid under high pressure into an oil or gas well. For example, the pumps can be mounted onto a skid 13 together with a prime mover (not shown) to provide a portable self-contained pumping unit. The prime mover can be an electric motor or an internal combustion engine (such as a diesel engine). The output of the prime mover is connected to a gear reducer 15.

Figure 2:
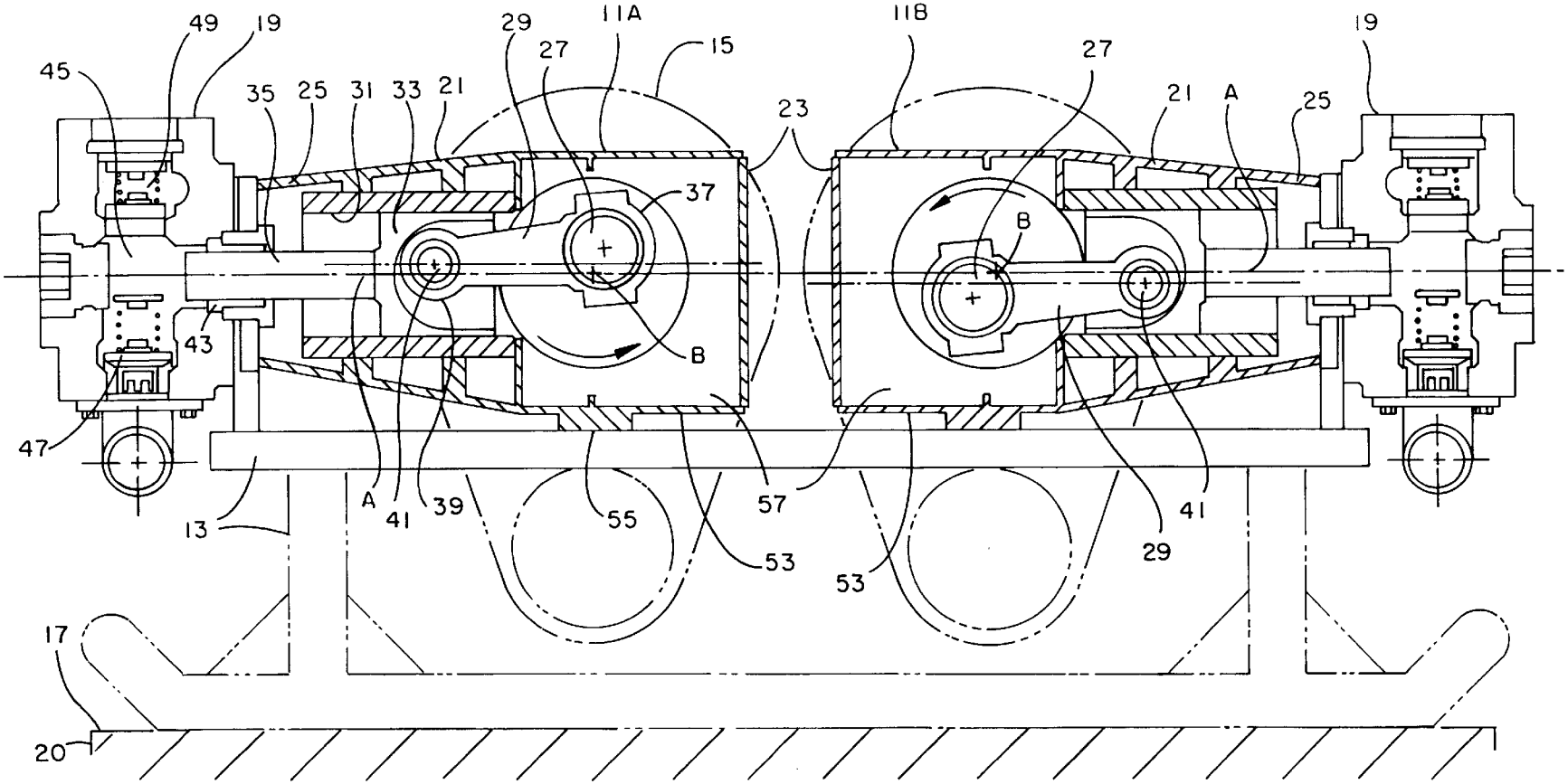
FIG. 2 is cross-sectional view of the two pumps of FIG. 1 taken along lines II—II.

FIG. 2 shows the two pumps mounted onto a flat bed trailer 17. With the present invention, the pumps 11A, 11B are compact in size so as to allow two pumps to extend across the width of the trailer 17. Furthermore, the pumps are oriented so that in output manifold 19 of each pump is located along an outside edge 20 of the trailer 17. This allows an operator to easily connect or disconnect hoses to the output manifold. The output manifold is accessible to a man that is standing on the ground next to the trailer. In addition, an operator can perform maintenance on the output manifold. Furtherstill, the input drives of both pumps are rotated in the same direction (in FIG. 2, the direction is shown as being counterclockwise). This is advantageous in that a single prime mover can be used to operate both pumps.

Referring back to FIG. 1, the pumps 11A, 11B will be described more specifically. Each pump 11A, 11B has a housing 21. The housing 21 has inboard end 23 and an outboard end 25. In the pump arrangement shown in the Figs., the inboard end 23 of one pump 11A is adjacent to the inboard end 23 of the other pump 11B. An output manifold 19 is connected to the outboard end 25 of each housing 21. The gear reducer 15 is provided along one of the sides of the respective pump, close to the inboard end 23.

Referring to FIG. 2, each pump utilizes the inboard end 23 to develop pumping power and the outboard end 25 to pump fluid. The power section of each pump has a crankshaft 27, connecting rods 29, cylinders 31, and crossheads 33.

The pumps shown in the figures are triplex pumps, wherein there are provided three plungers 35 for each pump. Consequently, the crankshaft 27 is connected to the three connecting rods 29. However, the invention can be utilized on other types of pumps.

Each connecting rod 29 is connected to a plunger 35 by way of a crosshead 33. Each connecting rod 29 has a crankshaft end 37 and a crosshead end 39. The crankshaft end 37 of each connecting rod 29 is connected to the crankshaft 27. The crosshead end 39 of each connecting rod 29 is connected to the respective crosshead 33. Specifically, the crosshead end 39 of the connecting rod 29 is connected to the crosshead by way of a wrist pin 41. The wrist pin 41 allows the connecting rod 29 to pivot with respect to the crosshead 33. Each crosshead 33 is located inside of a respective cylinder 31. The crosshead reciprocates inside of the respective cylinder. The cylinder 31 is fixed to the housing 21.

The output section of each pump includes the plungers 35 and the output manifold 19. Each plunger extends from the respective crosshead 33, through packing 43 and into the output manifold 19. The outer end of each plunger 35 reciprocates inside the output manifold. The output manifold 19 has a cavity 45 for each plunger 35. Each cavity 45 has an input valve 47 and an output valve 49. In accordance with conventional pump operations, the plunger moves between a suction stroke and an exhaust, or power, stroke. As the plunger 35 is withdrawn from the cavity during the suction stroke, fluid is pulled into the cavity 45 through the input valve 47. As the plunger is pushed into the cavity during the exhaust stroke, fluid is forced under pressure out through the output valve 49. Conduits (not shown), in form of hoses or pipes, are connected to the output manifold so as to bring fluid thereto and convey pressurized fluid away therefrom.

In each pump, each cylinder 31 has a longitudinal axis A. The plunger 35 and the crosshead 33 move along this longitudinal axis A. Likewise, the crankshaft 27 has a longitudinal axis B, about which axis the crankshaft rotates. The crankshaft axis B is perpendicular to the cylinder axis A. The crankshaft axis B is coplanar is with the cylinder axis A such that the two axes intersect. This is different than Matzner et al., U.S. Pat. No. 5,246,355, wherein the longitudinal axis of the cylinder is offset from the central line of the crankshaft.

Each pump is compact in length when compared to the type of pump shown in Giraudeau, U.S. Pat. No. 2,766,701. The distance between the housing inboard and outboard ends 23, 25 is shorter with the pump of the present invention. This is made possible by offsetting the wrist pin 41 from the cylinder axis. The wrist pin 41 is offset so as to provide a mechanical advantage during the exhaust stroke of the plunger 35. For example, referring to the orientation of the pumps 11A, 11B shown in FIG. 2, both crankshafts 29 are rotated in the counterclockwise direction. (FIG. 2 shows the plungers in the exhaust stroke.) In the left pump 11A, the exhaust stroke of the plunger occurs when the crankshaft end 37 of the connecting rod 29 is located above the cylinder axis A, as shown in FIG. 2. The wrist pin 41 for the left pump 11A is thus also located above the cylinder axis. In the right pump 11B, the exhaust stroke of the plunger 35 occurs when the crankshaft end 37 of the connecting rod 29 is located below the cylinder axis A, as shown in FIG. 2. The wrist pin 41 for the right pump 11B is also located below the cylinder axis A.

To make a pair of pumps, two housings 21 are manufactured. The housings are substantially similar to each other. Each housing contains cylinders 31 (three cylinders for a triplex pump) and two access ports 51. Each housing also has a bottom side 53 to which are attached feet 55 or pads. Each access port allows access to a cavity 57 that contains the crankshaft 27. For example, facing the inboard end 23 of a housing 21, that housing would have a left access port and a right access port. If the housing is to be used to make the left pump 11A of FIG. 2, then the gear reducer 15 is coupled to the right access port and the crankshaft 27 extends from the crankshaft cavity 57 through the right access port. The left access port is closed with a cover 59 (as shown in FIG. 1). If the housing is to be used to make the right pump 11B, then, facing the inboard end of the housing, the gear reducer 15 is coupled to the left access port and the crankshaft 27 extends through the crankshaft cavity 57 through the left access port. The right access port of this housing is closed with a cover 59 (as shown in FIG. 1).

With the present invention, short, compact pumps can be made simply and economically.

The foregoing disclosure and the showings made in the drawings are merely illustrative of the principles of this invention and are not to be interpreted in a limiting sense.

What is claimed is:

1. A system of pumps for use in servicing wells, comprising:

a) a first pump and a second pump;

b) each of the first and second pumps comprising:

i) a housing having a cylinder which has a cylinder axis, the housing having a first end and a second end;

ii) a plunger having a crosshead that is reciprocally carried in the cylinder for movement between a suction stroke and an exhaust stroke;

iii) a manifold mounted to the second end of the housing and being adjacent to the cylinder for supplying and delivering liquid acted on by the plunger;

iv) a crankshaft mounted rotatably in the housing and having a crankshaft axis that is perpendicular to the cylinder axis;

v) a connecting rod having a crankshaft end that is connected to the crankshaft and a crosshead end that is connected to the crosshead of the plunger by way of a wrist pin for reciprocating the plunger in response to the rotation of the crankshaft, the crankshaft end having a center line;

vi) the crankshaft axis being coplanar with the cylinder axis while the wrist pin of the connecting rod is offset from the cylinder axis;

c) the first and second pumps being arranged together so that the first end of the first pump housing is adjacent to the first end of the second pump housing;

d) the first pump has the first pump wrist pin located offset in a first direction from the first pump cylinder axis such that as the first pump plunger moves through its exhaust stroke the crankshaft end of the first pump connecting rod is located on the same side of the first pump cylinder axis as the first pump wrist pin; while the second pump has the second pump wrist pin located offset in a second direction from the second pump cylinder axis such that as the second pump plunger moves though its exhaust stroke the crankshaft end of the second pump connecting rod is located on the same side of the second pump cylinder axis as the second pump wrist pin.

2. The system of pumps of claim 1 wherein the first and second pumps are mounted on a vehicle, the vehicle having a width that extends between two sides, with the second end of the first pump housing being located adjacent to one of the vehicle sides and the second end of the second pump housing being located adjacent to the other of the vehicle sides.

3. A method of pumping fluid, comprising the steps of:

a) providing first and second pumps, each of which has a housing, each housing having an inboard end and an outboard end, with each outboard end having an output manifold;

b) mounting the first and second pumps so that the inboard ends are adjacent to each other, with each of the first and second pumps having a cylinder and a crankshaft, with the cylinder having a cylinder axis and a crankshaft having a crankshaft axis that is coplanar with the cylinder axis, with each of the first and second pumps having a connecting rod that connects to a crosshead in the cylinder by way of a wrist pin, the wrist pin being offset from the respective cylinder axis;

c) said step of mounting the first and second pumps further comprises orienting the first pump with respect to the second pump such that the wrist pin of the first pump is offset in a first direction from the first pump cylinder axis and the wrist pin of the second pump is offset in a second direction that is opposite from the first direction;

d) rotating the crankshaft of the first pump in a third direction so that both the wrist pin of the first pump and a crankshaft end of the connecting rod of the first pump are located on the same side of the first pump cylinder axis during an exhaust stroke of the first pump, and rotating the crankshaft of the second pump in a fourth direction so that both the wrist pin of the second pump and a crankshaft end of the connecting rod of the second pump are located on the same side of the second pump cylinder axis during an exhaust stroke of the second pump.

* * * * *